US007044066B1

(12) United States Patent
Miller

(10) Patent No.: US 7,044,066 B1
(45) Date of Patent: May 16, 2006

(54) PIN PALLET

(76) Inventor: Donald R. Miller, P.O. Box 272, Green, OH (US) 44232

( * ) Notice: Subject to any disclaimer, the term of this patent is extended or adjusted under 35 U.S.C. 154(b) by 386 days.

(21) Appl. No.: 10/617,123

(22) Filed: Jul. 10, 2003

Related U.S. Application Data

(60) Provisional application No. 60/395,237, filed on Jul. 11, 2002.

(51) Int. Cl.
*B65D 19/44* (2006.01)

(52) U.S. Cl. ..... 108/55.3; 108/54.1

(58) Field of Classification Search ..... 108/55.1, 108/55.3, 55.5, 54.1, 51.11; 206/386, 595, 206/596, 598, 600
See application file for complete search history.

(56) References Cited

U.S. PATENT DOCUMENTS

| | | | | | |
|---|---|---|---|---|---|
| 2,828,931 | A * | 4/1958 | Harvey | 108/54.1 |
| 3,626,872 | A * | 12/1971 | Cully | 108/55.1 |
| 3,695,187 | A * | 10/1972 | Weiss | 108/54.1 |
| 4,305,505 | A * | 12/1981 | Hickey | 108/54.1 |
| 4,309,013 | A | 1/1982 | Howe et al. | 248/346 |
| 4,314,686 | A | 2/1982 | Marz | 248/346 |
| 4,796,539 | A * | 1/1989 | Berrett | 108/55.1 |
| 4,915,033 | A | 4/1990 | Bond | 108/55.1 |
| 4,964,349 | A | 10/1990 | Bishop | 108/55.1 |
| 4,966,085 | A | 10/1990 | Howe | 108/55.1 |
| 4,977,836 | A * | 12/1990 | Bond | 108/55.1 |
| 5,297,485 | A | 3/1994 | Bond | 108/55.1 |
| 5,404,821 | A | 4/1995 | Bond | 108/55.1 |
| 5,644,992 | A | 7/1997 | Clive-Smith | 108/55.1 |
| 5,722,330 | A | 3/1998 | Staggers | 108/55.3 |
| 5,809,906 | A | 9/1998 | Janek | 108/57.15 |
| 5,810,186 | A * | 9/1998 | Lam | 108/55.1 |
| 6,474,245 | B1 * | 11/2002 | Richard | 108/54.1 |
| 6,543,370 | B1 * | 4/2003 | Bae | 108/55.1 |

* cited by examiner

*Primary Examiner*—Jose V. Chen
(74) *Attorney, Agent, or Firm*—Renner Kenner Greive Bobak Taylor & Weber

(57) ABSTRACT

A pallet includes a frame and at least one rail secured to the frame. The rail has a slot which slidably receives a pin mechanism. The pin mechanism includes a pallet pin that is moveable along the entire length of the slot, wherein the pallet pin is moveable between a position flush with the frame to a position substantially perpendicular with respect to the frame.

16 Claims, 10 Drawing Sheets

PIN PALLET

CROSS-REFERENCE TO RELATED APPLICATION

This application claims the benefit of U.S. Provisional Application No. 60/395,237 filed on Jul. 11, 2002.

TECHNICAL FIELD

The present invention is generally directed to pallets and more particularly to pallets with pin mechanisms that are slidable and pivotable.

BACKGROUND ART

Current pin pallets are configured with a frame and a plurality of perpendicularly extending pins. These pins are permanently welded into place for the purpose of holding shaped blank metal sheets that are to be stamped. The pallet is used to move the metal blanks from a storage location, or manufacturing station, to another location. The pins are positioned on the pallets so as to precisely position the metal blanks to allow for stamping equipment or robots to easily select one metal sheet for placement in a stamping machine. Accordingly, for different shaped metal blanks, a unique pin pallet is required with appropriately positioned pins to keep the metal blanks from shifting during movement from one location to another.

When a particular sized metal blank is no longer used in the manufacturer of a certain item, the pin pallet must be scrapped or re-worked to reconfigure placement of the metal pins into an appropriate position. A further drawback of the current pin pallet configuration is that when the pallets are not in use they take up valuable storage space in view of their size and profile.

Therefore, there is a need in the art for pin pallets which are re-configurable to various stamping shapes and sizes and also which are easily stored when not in use.

SUMMARY OF THE INVENTION

It is therefore an object of the present invention to provide a pin pallet.

Another object of the present invention, which shall become apparent as the detailed description proceeds, is achieved by a pallet comprising a frame; at least one rail secured to the frame, the at least one rail having a rail slot; and a pin mechanism slidably received in the slot, the pin mechanism having a pin that is moveable between a first and a second position.

A pin pallet comprising a frame; at least one rail secured to the frame, the at least one rail having a slot; and a pin mechanism slidably received in the slot, the pin mechanism having a pallet pin moveable along the entire length of the slot, wherein the pin mechanism includes a cam mechanism for selectively clamping and unclamping the pin mechanism to the at least one slot.

A pin pallet for holding metal stampings during transfer comprising a frame; at least one rail secured to the frame, the at least one rail having a slot; a pin mechanism slidably received in the slot including a locking plate received within the interior of the at least one rail, a slide plate positioned on the exterior of the at least one rail, and adapted to slide within the slot, the locking plate and the side plate having apertures therethrough, a mounting stub extending through the apertures and coupled to the locking plate, a pin collar provided at one end of the pallet pin, the pin collar having a pin collar bore adapted to receive the mounting stub, a handle assembly including a handle and a handle collar having a handle collar bore adapted to receive the mounting stub, a spring carried by the mounting stub, and interposed between the pin collar and the slide plate, and a cam mechanism incorporating the mounting stub and the handle assembly, the cam mechanism having a camming pin secured to the mounting stub, and a curvilinear cam slot disposed on the handle collar, wherein the camming pin and the curvilinear cam slot interact when the handle assembly is actuated to selectively lock and unlock the cam mechanism.

These and other objects of the present invention, as well as the advantages thereof over existing prior art forms, which will become apparent from the description to follow, are accomplished by the improvements hereinafter described and claimed.

BRIEF DESCRIPTION OF THE DRAWINGS

For a complete understanding of the objects, techniques and structure of the invention, reference should be made to the following detailed description and accompanying drawings, wherein.

BEST MODE FOR CARRYING OUT THE INVENTION

Figure 1:
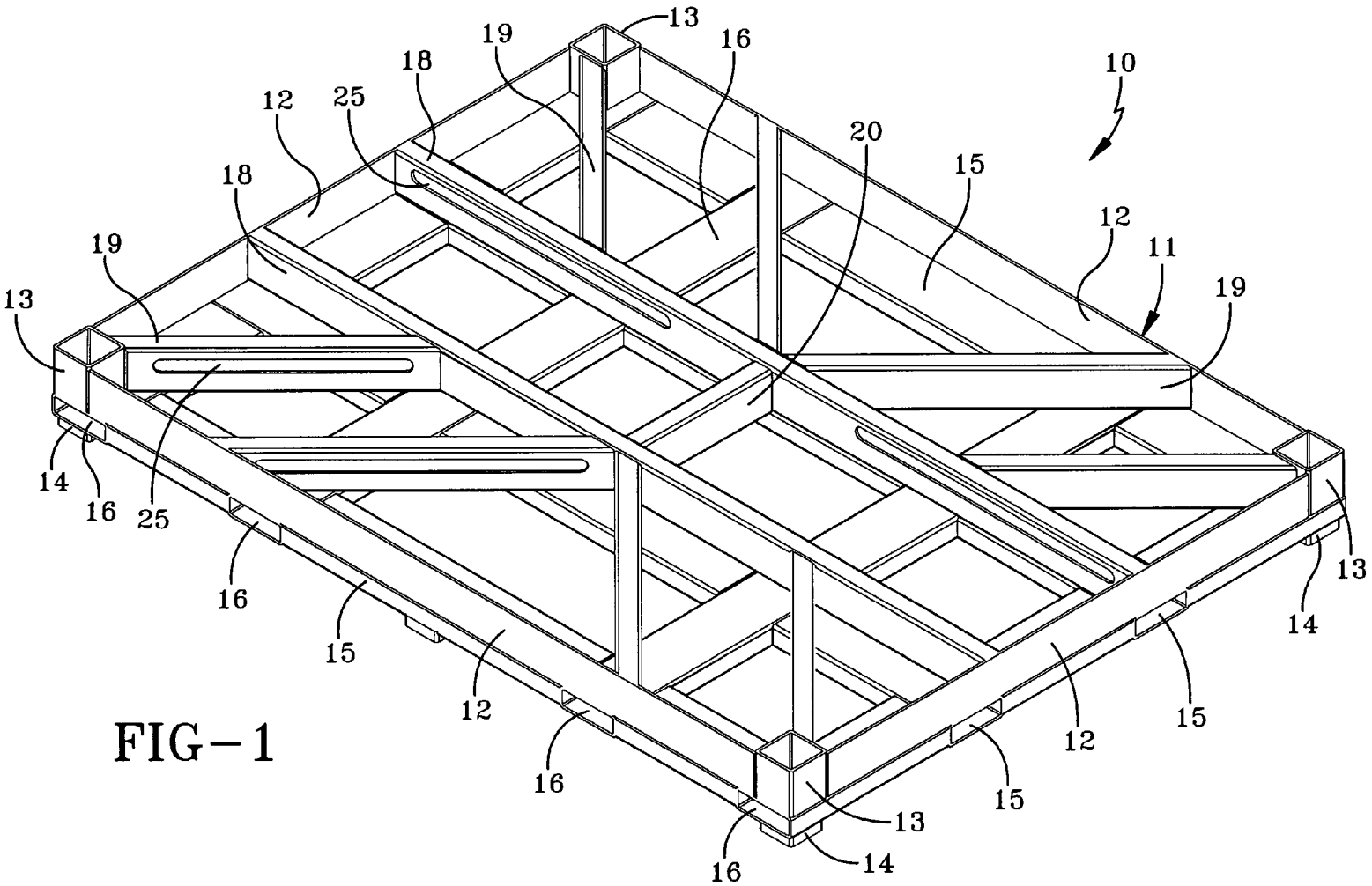
FIG. 1 is a perspective view of a pin pallet (without various pin mechanisms) according to the present invention.
Figure 2:
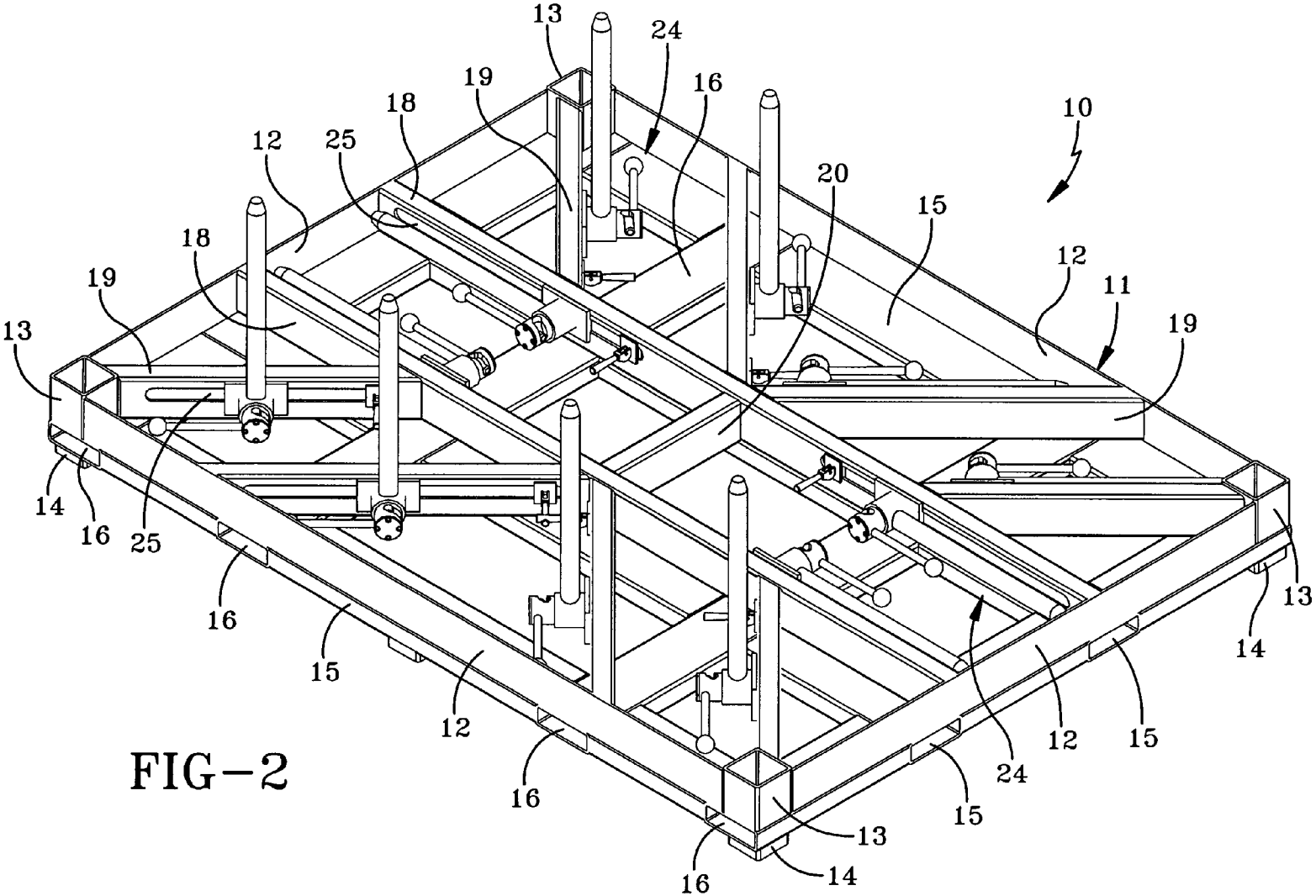
FIG. 2 is a perspective view of the pin pallet including various pin mechanisms according to the present invention.
Figure 3:
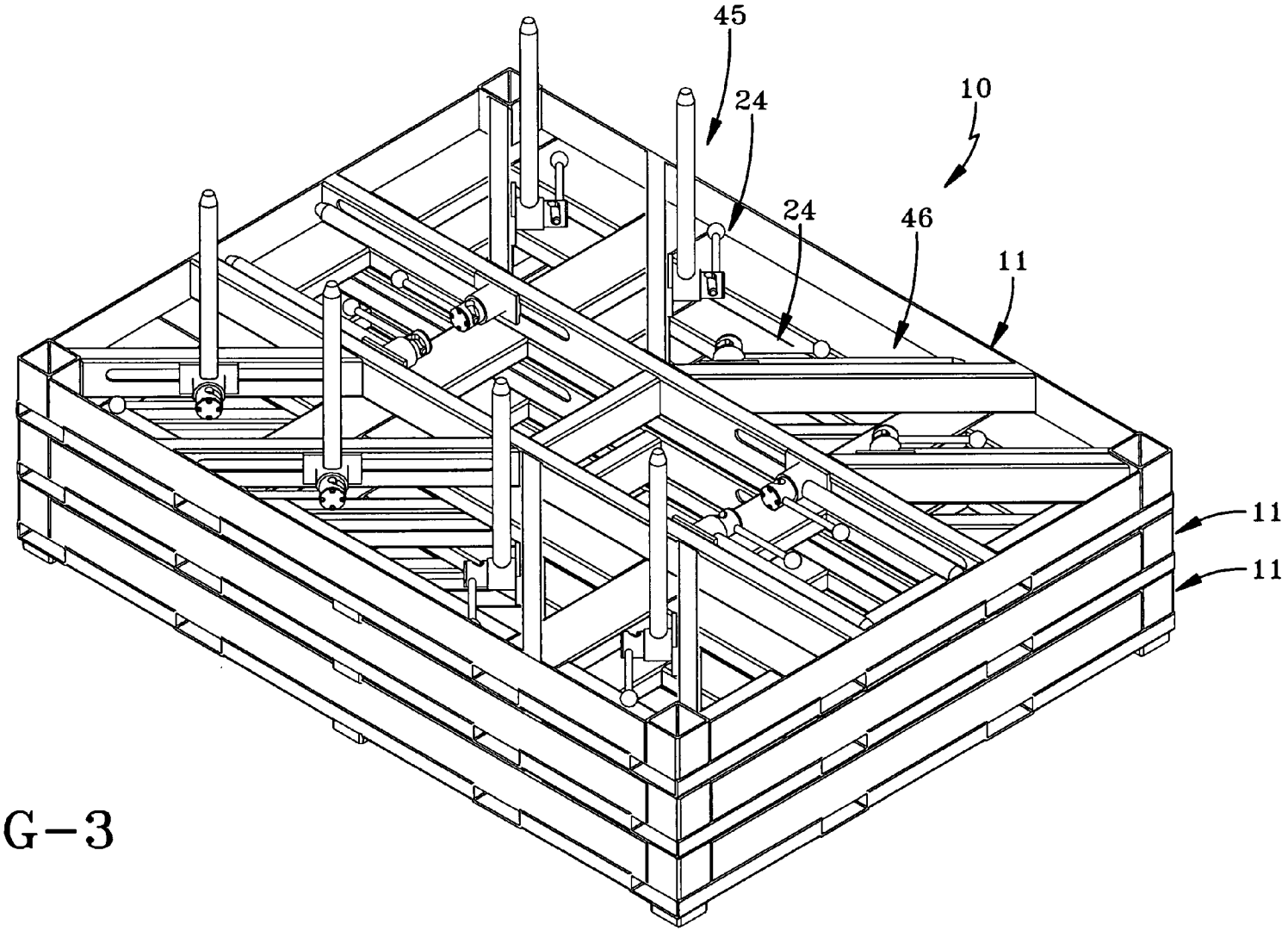
FIG. 3 is a perspective view of a pin pallet according to the present invention showing a plurality of pins in various positions and stacked upon pin pallets with their pins in a flush position.

Referring now to the drawings and in particular to FIGS. 1–3, it can be seen that a pallet according to the present invention is designated generally by the numeral 10. The pallet 10 includes a frame 11 which has a plurality of side members 12. As shown in the drawings, the side members 12 are arranged in a rectangular configuration. Positioned at each of the four corners of the frame 11 are four junction members 13. Each junction member 13 is substantially hollow, and joins adjacent side members 12 together. Altering the shape of the four junction members 13, and altering the length of the side members 12 will effect the shape of the frame 11. Therefore, it will be appreciated that the frame 11 could have a square configuration, or other shape deemed appropriate for the required application.

Extending downwardly from each junction member 13 are leg members 14. The leg members 14 have the same shape as the junction members 13, but are adapted to have smaller dimensions. Therefore, the leg members 14 are capable of nesting within the junction members of an underlying pallet, thereby allowing for efficient stacking of the pallets 10. In an alternative embodiment, the leg members 14 can be elongated to provide clearance between the frames 11 of stacked pallets 10. Such clearance allows pallets 10 loaded with metal stampings (not shown) to be stacked.

A plurality of longitudinal support ribs 15 and latitudinal support ribs 16 undergird the frame 11. The longitudinal support ribs 15 and latitudinal support ribs 16 extend across the frame 11 between the side members 12. As such, the longitudinal support ribs 15 and latitudinal support ribs 16 intersect in the interior of the frame 11.

Supported by the support ribs 15 and 16 in the middle portion 17 of the frame are two parallel rails 18 and various diagonal rails 19. The two parallel rails 18 are both parallel with two of the side members 12, and perpendicular with the other two of the side members 12. Positioned between the two parallel rails 18 is a support rail 20. The support rail 20 maintains the position of the parallel rails 18 with respect to one another. The diagonal rails 19 are all arranged between one of the parallel rails 18 and adjacent side members 12. Of course, the rails 18 and 19 could be arranged with respect to the frame as needed. As will be discussed hereinbelow, various pin mechanisms 24 are slidably mounted to the parallel rails 18 and diagonal rails 19. Furthermore, the diagonal rails 19 are arranged to maximize the available positions of various pin mechanisms 24. The pin mechanisms 24 allows the aforementioned metal stampings to be carried by the pallet 10 without shifting during transfer.

Provided on at least one side of each of the parallel rails 18 and the diagonal rails 19 are slots 25. The pin mechanisms 24 are slidably mounted within each of the slots 25. As a result, the pin mechanisms are capable of sliding along the length of a given slot 25. In the preferred embodiment, there is a single pin mechanism 24 carried in each of the slots 25, although it will be appreciated that more than one could be provided if desired.

As seen in FIGS. 4–7, each of the pin mechanisms 24 includes a handle assembly 26 and mounting stub 40. The handle assembly 26 is composed of a handle 27, a handle collar 28 which has a handle collar bore 29 therethrough. The handle 27 extends outwardly from the handle collar 28, and terminates in a spherical hand grip. The handle collar 28 has a cylindrical shape with side surfaces 32 and 33. A circular cross-sectioned handle collar bore 29 is provided through the axis of the handle collar 28 from the side surface 32 to the side surface 33.

As will be discussed hereinbelow, the handle assembly 26 in combination with the mounting stub 40 forms a cam mechanism 41. As best seen in FIGS. 2 and 3, actuation of handle assembly 26 locks and unlocks the cam mechanism 41, thereby allowing for the pivotal movement of a pallet pin 42 between a first position and a second position, and for securing the pin 42 is either position. Preferably, the first position is a vertical position indicated by the numeral 45 and the second position is a horizontal position indicated by the numeral 46. Furthermore, the horizontal position 46 refers to the pin 42 rotated 0° and 180° with respect to horizontal. The locking and unlocking of the cam mechanism 41 also, respectively, clamps and unclamps the pin mechanism 24 from the rails 18, 19. Therefore, when the cam mechanism 41 is unlocked, the pin mechanism 24 can slide along the length of a given slot 25.

The cam mechanism 41, which is best seen in FIGS. 6–9 is actuated using the handle assembly 26. For example, when the handle 27 is horizontal, the cam mechanism 41 is locked, and pin 42 is secured in place (likely in either the vertical position 45 or the horizontal position 46). However, depending upon the application, the configuration of the pin mechanism 24 can be altered to allow the pin 42 to be locked in various angular positions with respect to the frame 11. Furthermore, when the handle 27 is vertical, the cam mechanism 41 is unlocked allowing for the pin mechanism 24 to slide along the length of a given slot 25 and for the pivotal movement of the pin 42 between the vertical position 45 and the horizontal position 46.

When in the horizontal position 46, the pin 42 is flush with respect to the frame 11, and therefore, does not extend above the top surface of the side members 12. When in the vertical position 45, the pin 42 is substantially perpendicular with respect to the frame 11, and allows the aforementioned metal stampings to be carried by the pallet 10 without shifting during transfer.

Figures 4, 5:
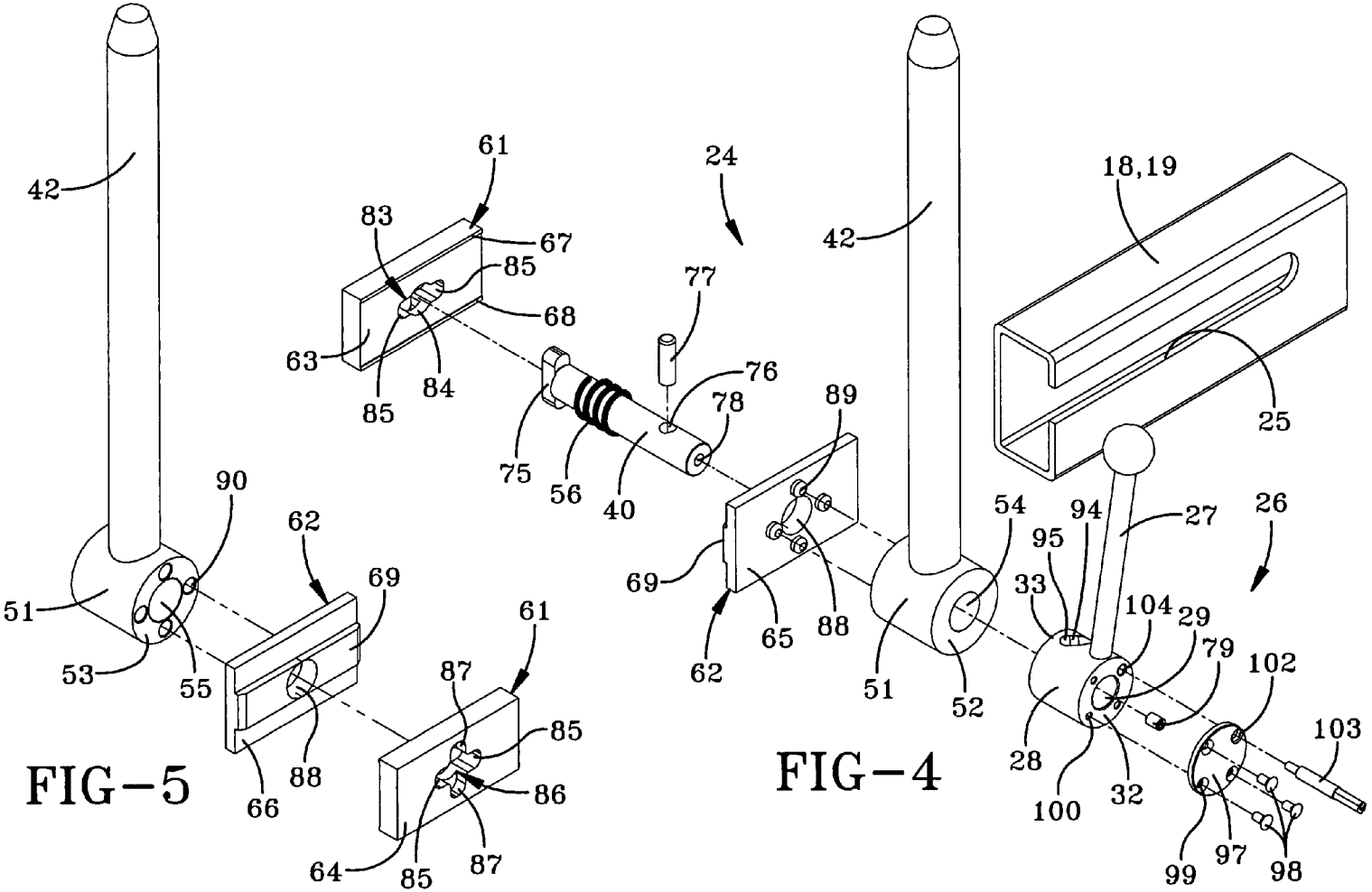
FIG. 4 is an exploded front perspective view of the pin mechanism according to the present invention including a cam mechanism and a locking pin.
FIG. 5 is an exploded rear perspective view of a portion of the pin mechanism according to the present invention.

Referring to FIGS. 4 and 5, a detailed depiction of the pin 42 is shown. One end of the pin 42 is provided with a frustoconical shape for carrying the aforementioned metal stampings. The other end of the pin 42 is provided with a pin collar 51. The pin collar 51 has a cylindrical shape with side surfaces 52 and 53. Extending through the axis of the pin collar 51 from the side surface 52 to the side surface 53 is a circular cross-sectioned pin collar bore 54. The pin collar bore 54 is adapted to receive the mounting stub 40 on which the pin 42 is rotatable, and therefore, is capable of pivotal movement between the vertical and horizontal positions 45 and 46. Furthermore, to assist in locking and unlocking the cam mechanism 41, the mounting stub 40 is slidably and rotatably received in the pin collar bore 54.

A circular cross-sectioned spring sleeve 55 is formed adjacent to the side surface 53. The pin collar bore 54 and the spring sleeve 55 share the same axis, however, the diameter of the spring sleeve 55 is slightly larger than the diameter of pin collar bore 54. The spring sleeve 55 is adapted to accommodate a spring 56 carried by the mounting stub 40, and positioned between the mounting stub 40 and the pin collar 51. The spring 56 is used to bias the collar 51 and the pin 42 away from the rails 18, 19.

In addition to the handle assembly 26 and pin 42, the pin mechanism 24 is further composed of the mounting stub 40, and a locking plate 61 and a slide plate 62. Both the locking plate 61 and slide plate 62 are substantially rectangular in shape. The locking plate 61 has a first surface 63 and a second surface 64, and the slide plate 62 has a first surface 65 and second surface 66.

The locking plate 61 is received within the interior of the rails 18, 19, while the slide plate 62 is positioned on the exterior of the rails 18, 19. Extending along the first surface 63, and positioned along the top and bottom edges of the locking plate 61 are parallel rails 67 and 68. When received within the interior of rails 18, 19, the parallel rails 67 and 68 interface with the interior surface of the rails 18, 19. The parallel rails 67 and 68 are configured to reduce friction when the pin mechanism 24 slides along the length of a given slot 25. Furthermore, the slide plate 62 includes a rib 69 extending along second surface 66, and adapted to slide within the slot 25. When the pin mechanism 41 is assembled, the rib 69 maintains the alignment of the pin mechanism 24 with respect to the rails 18, 19. In addition, both the locking plate 61 and slide plate 62 include apertures for accommodating the mounting stub 40.

Figure 6:
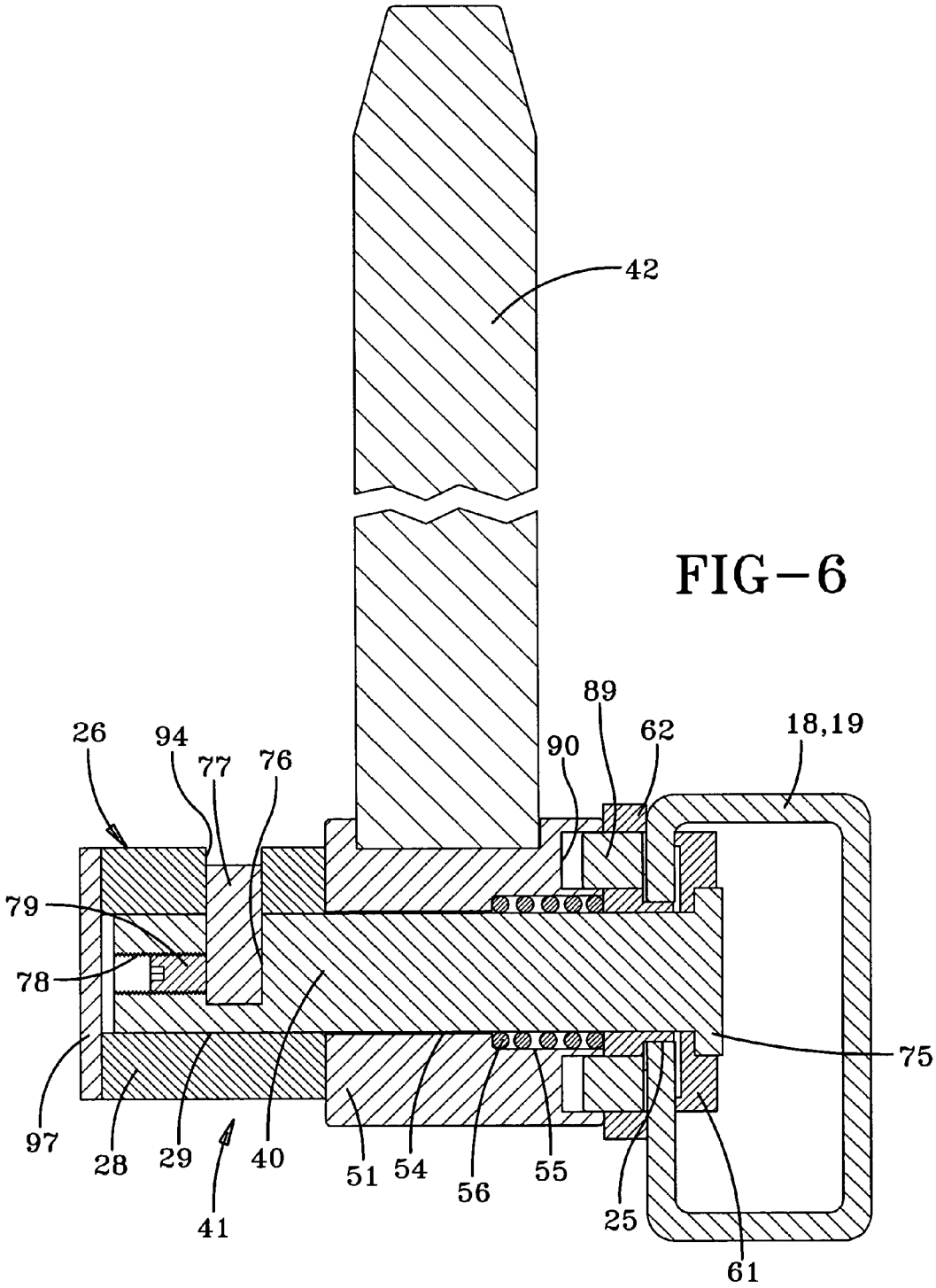
FIG. 6 is a cross-sectional view of the pin mechanism when the pin is in a vertical position and the cam mechanism is locked.
Figure 7:
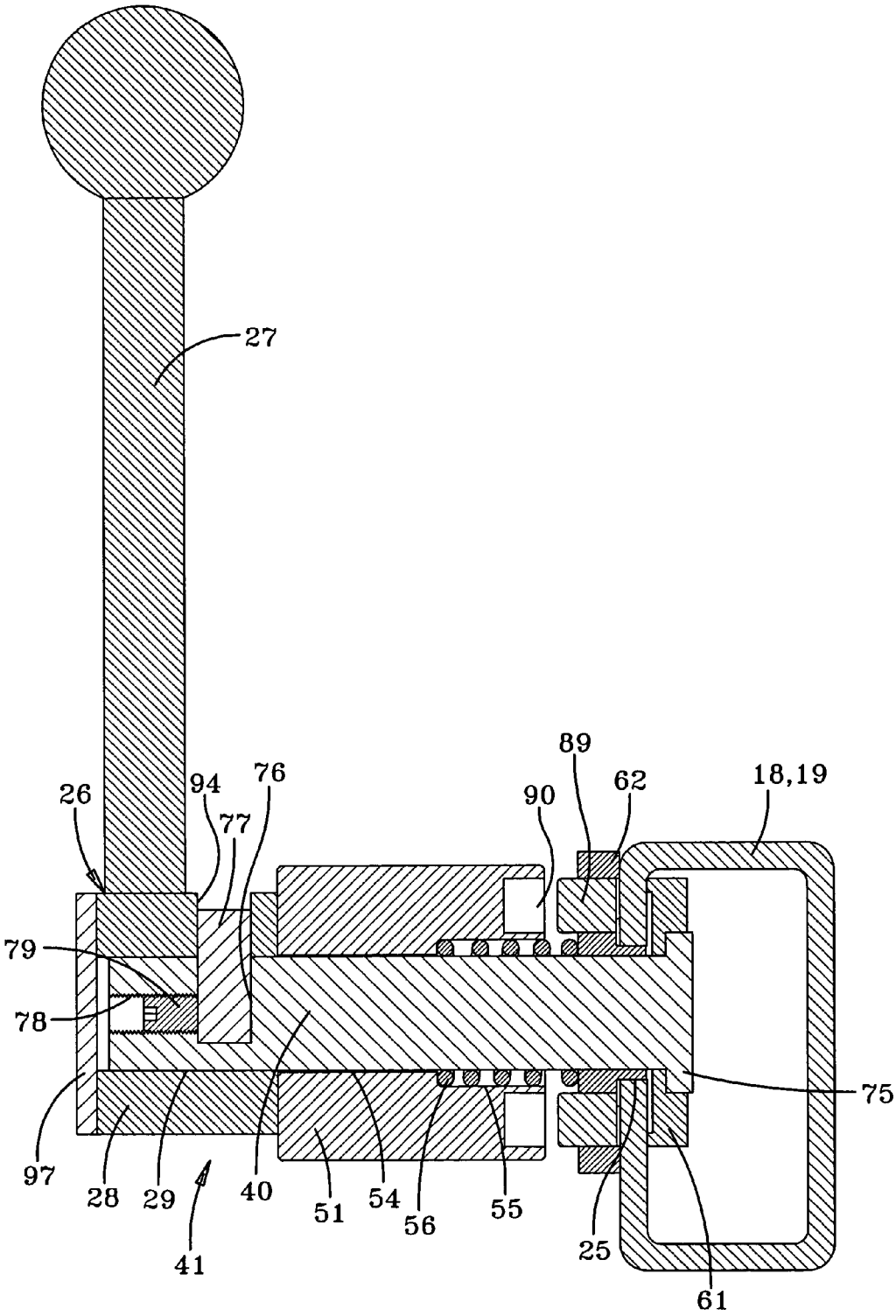
FIG. 7 is a cross-sectional view of the pin mechanism when the pin is in a horizontal position and the cam mechanism is unlocked.

The mounting stub 40 has a cylindrical shape, and is provided with a key 75. Ultimately, the mounting stub 40 is inserted through the apertures in the locking plate 61 and the slide plate 62, the pin collar bore 54 of the pin collar 51, and the handle collar bore 29 of the handle collar 28, and collectively forms the pin mechanism 24. Furthermore, as a main component of the cam mechanism 41 (as best seen in FIGS. 6 and 7), the mounting stub 40 includes a cross hole 76 that receives a camming pin 77. Briefly, the camming pin 77 operates in conjunction with the handle assembly 26 to facilitate the locking and unlocking of the cam mechanism 41. For example, the camming pin 77 is ultimately inserted into a curvilinear slot 94 located on the handle collar 28. When the handle 27 is rotated, the camming action of the camming pin 77 within the curvilinear slot 94 allows the handle collar 28 to slide axially along the mounting stub 40. The mounting stub 40 also includes an axial hole 78 provided at the opposite end from the key 75. The axial hole 78 receives a set screw 79 which is used to secure the camming pin 77 to the mounting stub 40.

The aperture extending though the locking plate 61 from the first surface 63 to the second surface 64 is a through key 83. The through key 83 has a bow-tie configuration. That is, the through key 83 includes a substantially cylindrical center portion 84 adapted to accommodate the mounting stub 40, and opposed slots 85 extending outwardly from the center portion 84 adapted to accommodate the key 75. Furthermore, extending from the second surface 64 to the center of the locking plate 61 is a blind key 86. The blind key 86 is substantially perpendicular to the through key 83, and forms opposed key ledges 87. When the pin mechanism 41 is assembled, the key 75 of the mounting stub 40 is fixedly captured between the opposed key ledges 87.

The aperture extending though the slide plate 62 is a mounting stub hole 88. The mounting stub hole 88 is substantially cylindrical, and extends from the first surface 65 to the second surface 66 and is aligned with the through key 83. The mounting stub hole 88 is adapted to accommodate the mounting stub 40. A plurality of dowel pins 89 (as seen best in FIG. 4) are preferably positioned at 90° intervals around the mounting stub hole 88 on the first surface 65. Furthermore, the side surface 53 of the pin collar 51 includes a plurality of locating bores 90 (as best seen in FIG. 5) preferably positioned at 90° intervals around the pin collar bore 54, and sized and positioned to receive the dowel pins 89. However, the placement of the dowel pins 89 and the locating bores 90 could be interchanged. As such, the dowel pins 89 could be positioned around the pin collar bore 54, and the locating bores 90 could be positioned around the mounting stub hole 88 on the first surface 65. The dowel pins 89 and locating bores 90 operate in conjunction with the cam mechanism 41 to lock the pin 42 in the vertical and horizontal positions 45 and 46 as desired.

As discussed hereinabove, the cam mechanism 41 includes the mounting stub 40 and the handle assembly 26 composed of the handle 27, the handle collar 28, and handle collar bore 29. To assemble the cam mechanism 41, the mounting stub 40 is inserted into the handle collar bore 29, and the handle collar 28 is rotatably and slidably received upon the mounting stub 40. As discussed above, the handle collar 28 incorporates a curvilinear slot 94 sized to accommodate the camming pin 77 secured to the mounting stub 40. When the handle 27 is rotated, the camming action of camming pin 77 within the curvilinear slot 94 allows the handle collar 28 to slide axially along the mounting stub 40. That is, the camming action provides for the axial movement of the handle assembly 26 along the mounting stub 40 inwardly and outwardly relative to the rails 18, 19. At the same time, the camming pin 77 prevents the handle collar 28 from sliding off the mounting stub 40. Furthermore, to assist the aforementioned camming action, the curvilinear cam slot 95 is provided with a cam notch 95. The cam notch 95 provides a space accommodating the camming pin 77 when the cam mechanism is unlocked, and, as will be discussed below, also provides the initial or final (when locking or unlocking, respectively) portion of the axial movement of the handle assembly 26 along the mounting stub 40. The cam notch 95 has greater slope than the curvilinear cam slot 95, and, as will be discussed below, provides for abrupt axial movement of the handle collar 28 along the mounting stub 40.

Figure 8:
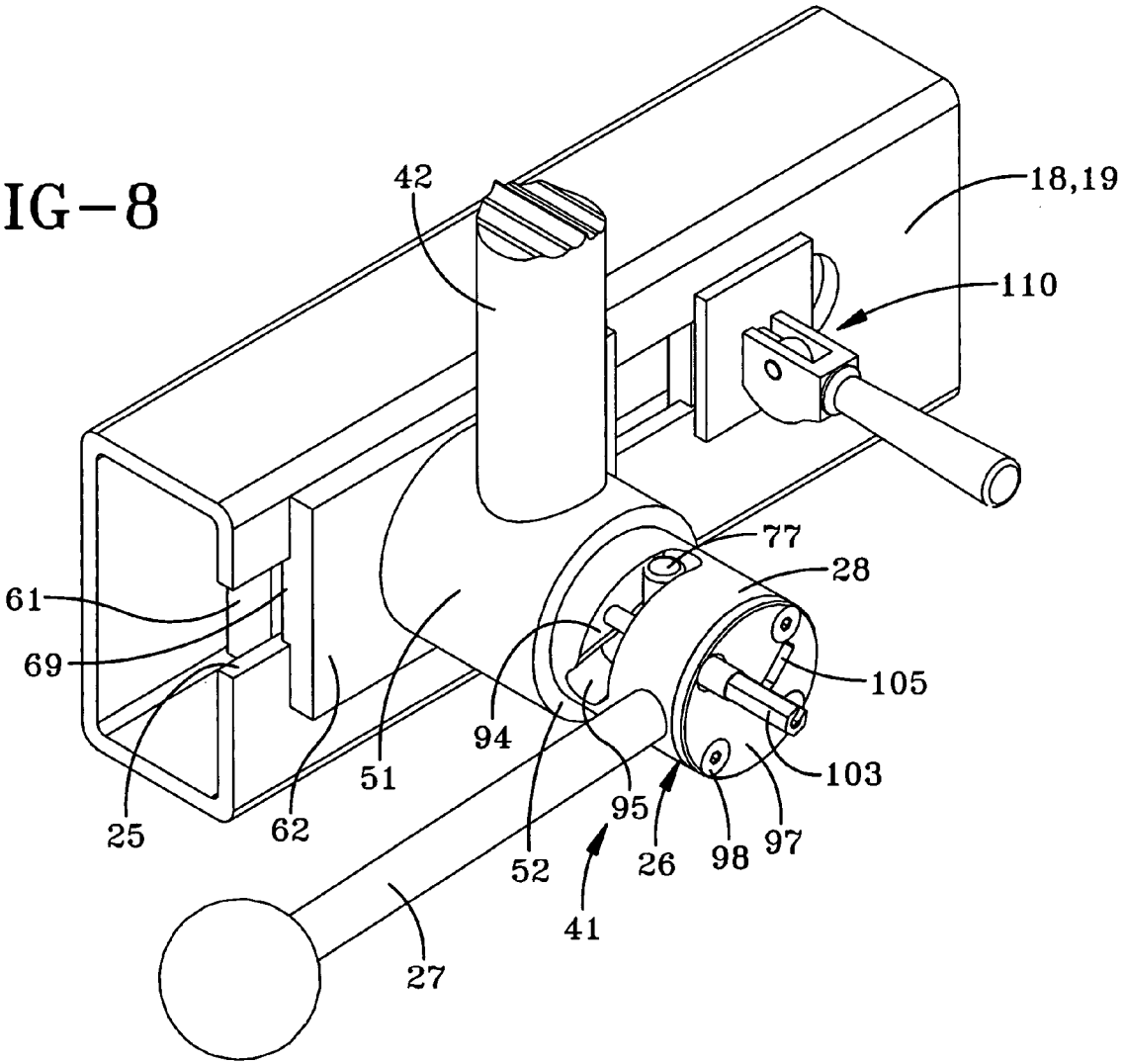
FIG. 8 is a perspective view of the pin mechanism when the cam mechanism is locked and the locking pin is engaged.
Figure 9:
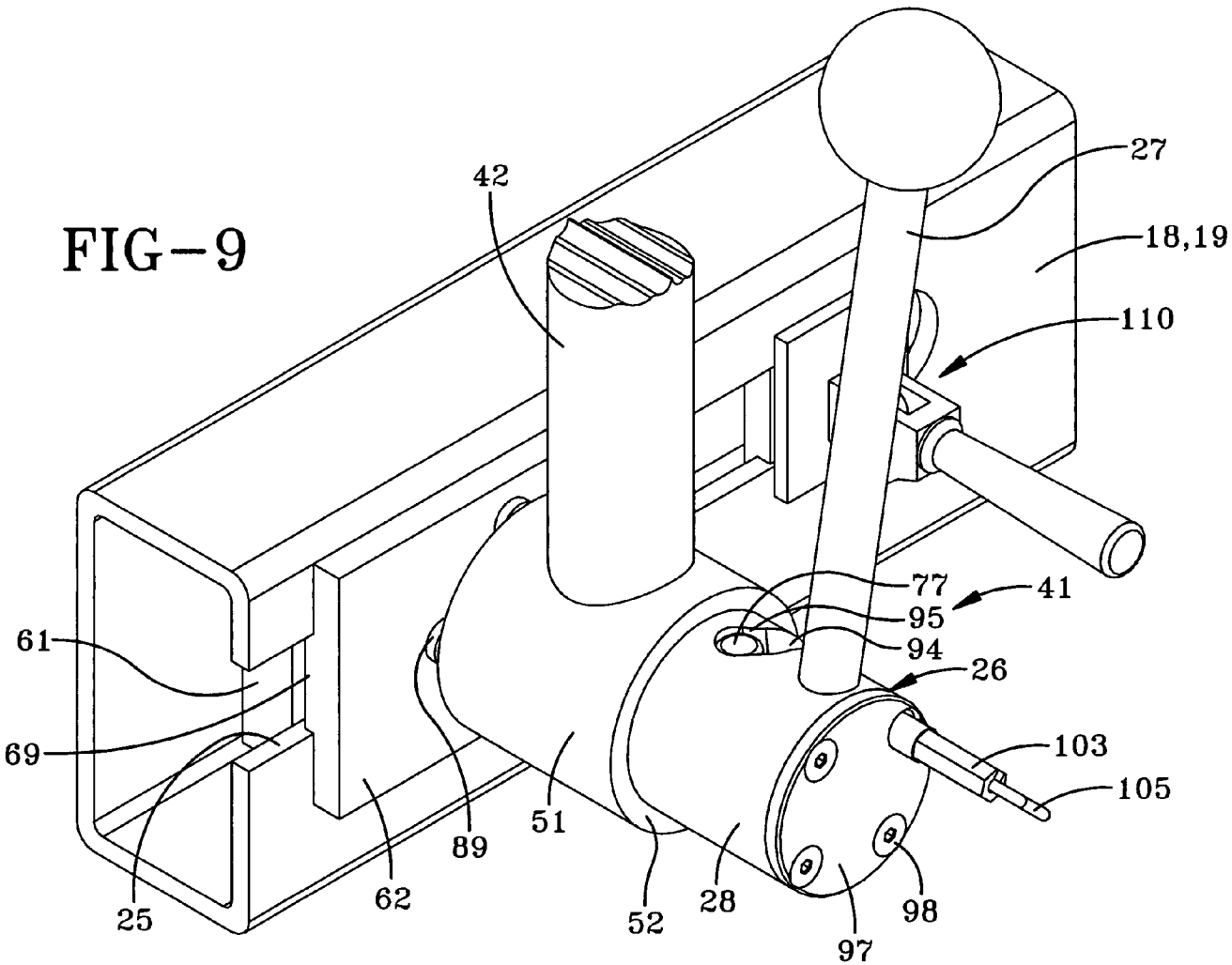
FIG. 9 is a perspective view of the pin mechanism when the cam mechanism is unlocked and the locking pin is disengaged.

A cover plate 97 is attached to the side surface 32 of the handle collar 28 using threaded fasteners 98 inserted into holes 99 provided in the cover plate 97, and threaded holes 100 provided in the side surface 32. The cover plate 97 is used to shield the cam mechanism 41, and to provide a hole 102 for accommodating the safety pin mechanism 103. The safety pin mechanism 103 includes a safety pin 105 that is used block movement of the handle assembly 26 relative to the mounting stub 40. The safety pin 105 is capable of axial movement within the safety pin mechanism 103 between an engaged and a disengaged position. For example, with reference to FIG. 8, the handle assembly 26 is horizontally oriented. In FIG. 8, the safety pin 105 is engaged, and, therefore, is inserted into a safety hole 104 that is aligned with the hole 102 and safety pin mechanism 103. The safety hole 104 is provided through the handle collar 28, and traverses the curvilinear slot 94. As such, when the safety pin 105 is engaged, the safety pin 105 prevents movement of the handle assembly 26 relative to the mounting stub 40 by colliding with the camming pin 77. The safety pin 105 can be used to prevent inadvertent movement of the handle assembly 26 relative to the mounting stub 40 when the handle assembly 26 is horizontally or vertically oriented, and the cam mechanism 41 is, respectively, locked or unlocked.

When the cam mechanism 41 is locked (as seen in FIGS. 6 and 8), the dowel pins 89 are inserted in the locating bores 90, the handle 27 is horizontal, and the safety pin 105 is engaged with the safety hole 104 to block inadvertent movement of the handle assembly 26 with respect to the mounting stub 40. As such, the pin 42 is held in either the vertical position 45 or the horizontal position 46 by the dowel pins 89 and the locating bores 90, and the pin mechanism 24 cannot be moved along the slot 25 because the rails 18,19 are clamped between the locking plate 61 and the slide plate 62.

When the safety pin 105 is disengaged from the safety hole 104, then cam mechanism 41 can be changed from being locked to unlocked or from being unlocked to locked. For example, the cam mechanism 41 is unlocked by applying force to rotate the handle 27 of the handle assembly 26 from horizontal to vertical. During unlocking movement, the interaction of the camming pin 77 within the curvilinear slot 94 and cam notch 95 causes the handle assembly 26 to move outwardly relative to the rails 18, 19 along the mounting stub 40, and such outward movement effectively unclamps the rails 18, 19 from between the locking plate 61 and slide plate 62. Conversely, the cam mechanism 41 is locked by applying force to rotate the handle 27 of the handle assembly 26 from vertical to horizontal. During locking movement, the interaction of the camming pin 77 with the curvilinear slot 94 and cam notch 95 causes the handle assembly to move inwardly relative to the rails 18, 19 along the mounting stub 40, and such inward movement effectively clamps the rails 18, 19 between the locking plate 61 and slide plate 62.

When the cam mechanism 41 is being unlocked, the final movement of the handle assembly 26 relative to the rails 18, 19 is provided by the interaction of the camming pin 77 within the cam notch 95. For example, after a smooth transition within the curvilinear slot 94, the interaction between the camming pin 77 and the cam notch 95 abruptly moves the handle collar 28 outwardly relative to the rails 18, 19 along the mounting stub 40. Conversely, when the cam mechanism 41 is being locked, the initial movement of the handle assembly 26 relative to the rails 18, 19 is provided by the interaction of the camming pin 77 within the cam notch 95. For example, before a smooth transition within the curvilinear slot 94, the interaction between the camming pin 77 and the cam notch abruptly moves the handle collar 28 inwardly relative to the rails 18, 19 along the mounting stub 40. It will be appreciated that the abrupt movement of the handle collar 28 relative to the rails 18, 19 assists to insert the dowel pins 89 into the locating bores 90 and to withdraw the dowel pins 89 from the locating bores 90 when respectively locking and unlocking the cam mechanism 41.

During operation, when the cam mechanism 41 is being unlocked, the handle 27 of the handle assembly 26 is rotated from horizontal to vertical, and the subsequent outward movement of the handle collar 28 along the mounting stub 40 is assisted by the spring 56, which, as discussed above, is used to bias the pin 42 away from the rails 18, 19. Because side surface 33 of the handle collar 28 abuts the side surface 52 of the pin collar 51, the spring 56 also biases the handle assembly 26 away from the rails 18, 19. Therefore, when the cam mechanism 41 is being unlocked, both the handle collar 28 and the pin collar 51 move outwardly relative to the rails 18, 19 along the mounting stub 40.

Such outward movement unclamps the rails 18, 19 from between the locking plate 61 and the slide plate 62, and allows the pin mechanism 24 to be moved along the length of a given slot 25. Such outward movement also withdraws the dowel pins 89 from the locating bores 90, and allows for pivotal movement of the pin 42 about the mounting stub 40. Furthermore, once the pin mechanism 24 is positioned along the length of a given slot 25, and the pin 42 is positioned in either the vertical position 45 or the horizontal position 46, the handle 27 of the handle assembly 26 is rotated from vertical to horizontal, whereby the aforementioned camming action overcomes the spring 56, both the handle collar 28 and the pin collar 51 move inwardly relative to the rails 18, 19, and the dowel pins 89 are inserted into locating bores 90 to secure the pin mechanism 24 in position.

Figure 10:
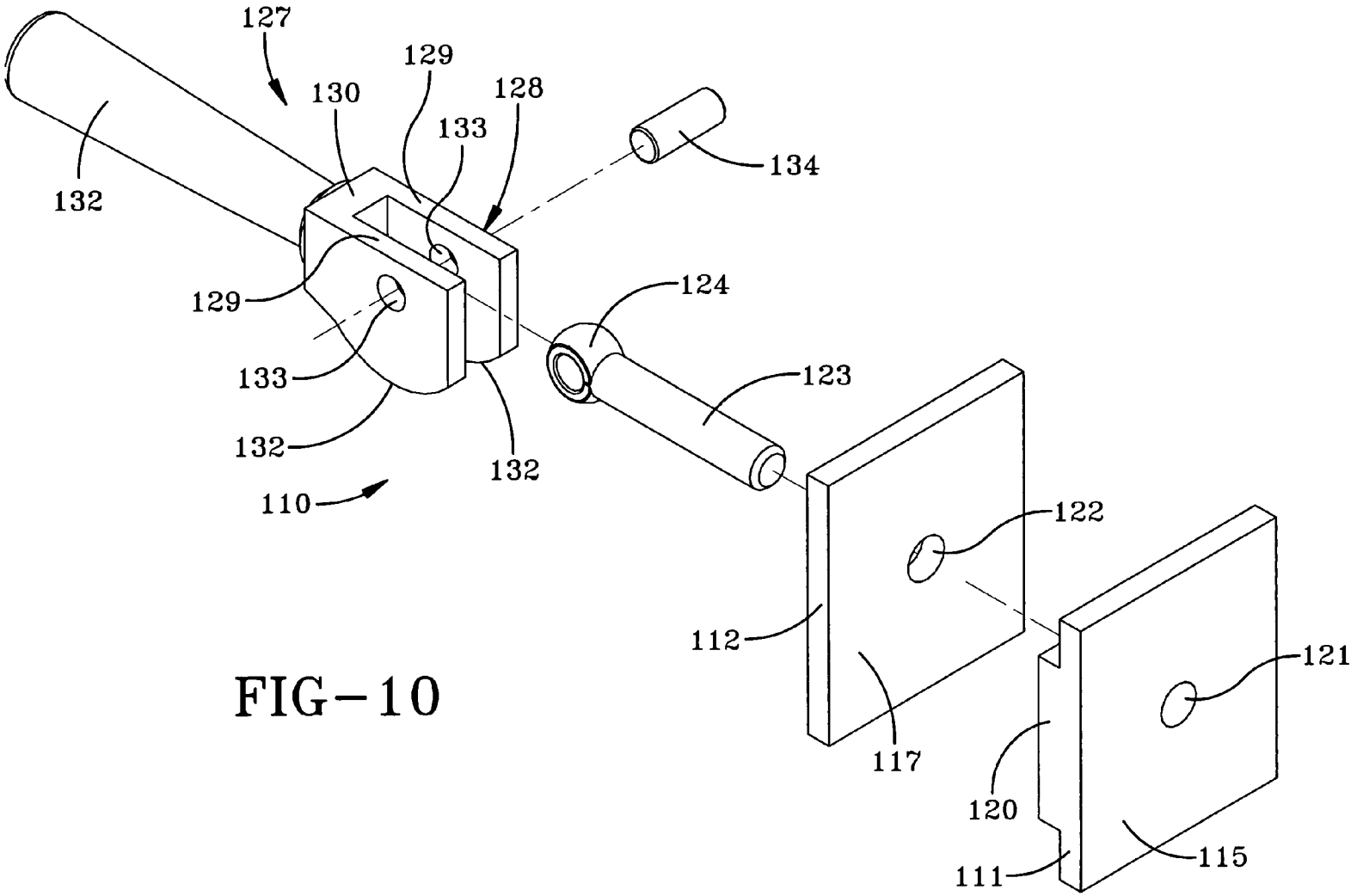
FIG. 10 is an exploded rear perspective view of a stop assembly.
Figure 11:
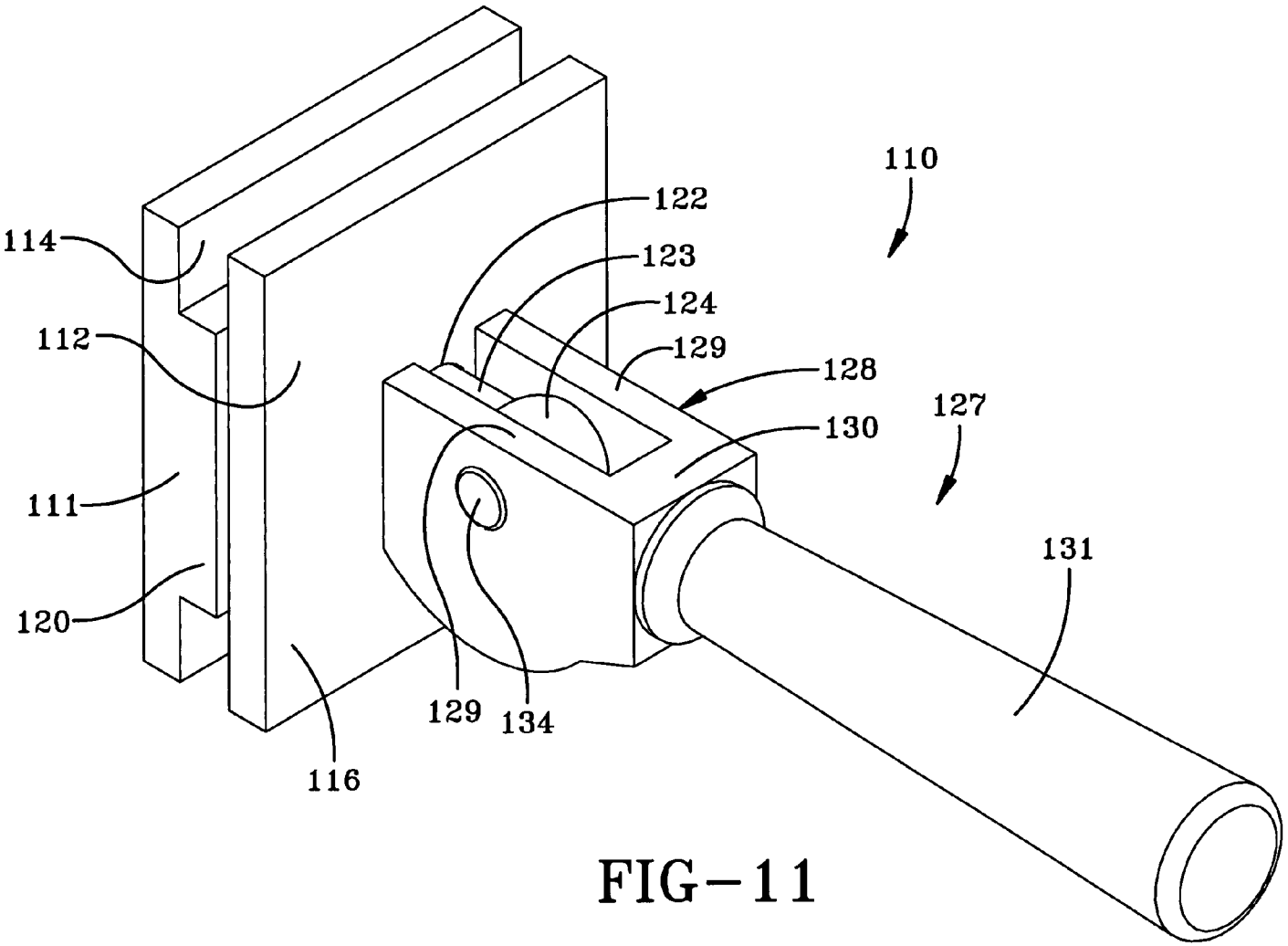
FIG. 11 is a front perspective view of the stop assembly.

As shown in FIGS. 2, 3, 8, and 9, and in detail in FIGS. 10 and 11, a stop assembly is designated generally by the numeral 110. The stop assembly 110 includes a back plate 111 and a guide plate 112. Both the back plate 111 and the guide plate 112 are substantially square-shaped. The back plate 111 is received within the interior of the rails 18, 19, while the guide plate 112 is positioned on the exterior of the rails 18, 19. The back plate 112 has first and second surfaces 114 and 115, respectively, and the guide plate has first and second surfaces 116 and 117, respectively. A rib 120 is provided on the first surface 114 of the back plate 112, and like the rib 69, the rib 120 is adapted to slide within the slot 25. When the pin mechanism 41 is assembled, the rib 120 maintains alignment of the stop assembly 110 with respect to the rails 18, 19.

The back plate 111 and the guide plate 112 are provided with matching substantially circular holes 121 and 122, respectively. The hole 122 in the guide plate 112 is threaded to receive the cylindrical stop pin 123. For example, when the back plate 111 and the guide plate 112 are properly aligned, a cylindrical stop pin 123 having a threaded end connection can be inserted through the matching holes 121 and 122, and secured to the back plate 111. The opposite end of the stop pin 123 is provided with a collar 124.

The collar 124 is used to attach the stop pin 123 to the lock handle assembly 127. The lock handle assembly 127 includes a U-shaped saddle 128 and handle 131. The U-shape of the saddle 128 is formed by opposed legs 129 connected via connection leg 130. Attached to the connection leg 130, and extending in an opposite direction from the opposed legs 129 is the handle 131. The opposed legs 129 are provided with camming surfaces 132 and opposed holes 133. The collar 124 (and the attached handle 131) is pivotably coupled to the saddle 128 by using a bushing 134 inserted through the collar 124 and opposed holes 133.

When the handle 131 is pivoted to a vertical holding position, the camming action caused by the interaction of the camming surfaces 132 and the first surface 116 of the guide plate 112 provides a force that captures the rails 18, 19 between the back plate 111 and the guide plate 112. As a result of this capturing force, the stop assembly 110 is effectively rendered immovable. Furthermore, when the handle 131 is pivoted to a horizontal release position, the capturing force is released, and the stop assembly 110 is capable of sliding along the length of the slot 25. The general purpose of the stop assembly 110 is to provide a dead length stop for the pin mechanism 24. For example, the machine operator will set the pin mechanism 24 at a certain position along the length of a given slot 25.

The advantages of the present invention are readily apparent. Primarily, the present invention allows for the pins to be moved from one position to another to accommodate differently sized metal stampings. Accordingly, the pallet may be re-configured between manufacturing runs of a certain item, or may be utilized with differently sized metal stampings in the same manufacturing run. In any event, when the manufacturing run is complete, or the pin pallet is no longer required, the pins may all be placed in a flush position to allow for compact storage of the pallet. Savings on storage space and also on the cost of re-working the pallet pins to meet a particular size of the metal stampings are obtained with this invention. A further advantage of the present invention is the pin mechanism which allows for slidable and rotatable movement of the pin mechanisms with respect to the pin pallet.

Thus, it can be seen that the objects of the invention have been satisfied by the structure and its method for use presented above. While in accordance with the Patent Statutes, only the best mode and preferred embodiment has been presented and described in detail, it is to be understood that the invention is not limited thereto or thereby. Accordingly, for an appreciation of the true scope and breadth of the invention, reference should be made to the following claims.

What is claimed is:

1. A pallet comprising:

a frame;

at least one rail secured to said frame, said at least one rail having a rail slot;

a pin mechanism slidably received in said rail slot, said pin mechanism having a pallet pin that is moveable along the entire length of said rail slot, a slide plate slidably received in said rail slot, said slide plate having at least one outwardly extending dowel pin, a stub coupled to said slide plate, a collar rotatably carried by said stub, said collar having at least one bore that receives said dowel pin, wherein said pallet pin is secured to said collar, a cam mechanism secured to said stub, said cam mechanism having a cam slot, a cam pin secured to said stub and slidably extending through said cam slot and a spring carried by said stub and interposed between said collar and said slide plate, wherein movement of said cam pin from a locked position allows pivotable movement of said collar and slidable movement of said slide plate.

2. The pallet according to claim 1, wherein said pallet pin is moveable between a position flush with said frame to a position substantially perpendicular with respect to said frame.

3. The pallet according to claim 1, further comprising:

a plurality of feet downwardly extending from said frame for nesting said frame within an adjacent frame.

4. The pallet according to claim 1, further comprising:

a stop assembly slidably received in said slot to allow repeatable re-positioning of said pin mechanism anywhere in said slot.

5. A pin pallet comprising:

a frame;

at least one rail secured to said frame, said at least one rail having a slot;

a pin mechanism slidably received in said slot, said pin mechanism having a pallet pin moveable along the entire length of said slot, said pin mechanism includes a cam mechanism for selectively clamping and unclamping said pin mechanism to said at least one slot, a locking plate received within the interior of said at least one rail, a slide plate positioned on the exterior of said at least one rail, and adapted to slide within said slot, a mounting stub extending through apertures in said locking plate and said side plate and coupled to said locking plate, a pin collar provided at one end of said pallet pin, said pin collar having a pin collar bore adapted to receive said mounting stub, a handle assembly including a handle and a handle collar having a handle collar bore adapted to receive said mounting stub, a spring carried by said mounting stub, and interposed between said pin collar and said slide plate; and said cam mechanism incorporating said mounting stub and said handle assembly, said cam mechanism having a camming pin secured to said mounting stub, and a curvilinear cam slot disposed on said handle collar, wherein said camming pin and said curvilinear cam slot interact when said handle assembly is actuated to selectively lock and unlock said cam mechanism.

6. The pin pallet according to claim 5, wherein said cam mechanism selectively secures said pallet pin in a first position and a second position.

7. A pin pallet according to claim 6 wherein said pallet pin is selectively secured in said first position and said second position and said pin mechanism is clamped to said at least one rail when said cam mechanism is locked, and wherein said pallet pin is rotatable about said mounting stub and is moveable along the entire length of said slot when said cam mechanism is unlocked.

8. The pin pallet according to claim 7, wherein as said cam mechanism is being locked by the actuation of said handle assembly, both said handle collar and said pin collar move axially along said mounting stub and inwardly relative to said at least one rail, and as said cam mechanism is being unlocked by the actuation of said handle assembly, both said handle collar and said pin collar move axially along said mounting stub and outwardly relative to said at least one rail.

9. The pin pallet according to claim 8, said pin mechanism further including:

at least one dowel pin extending outwardly from said slide plate, and at least two locating bores positioned on said pin collar, wherein said at least one dowel pin is inserted in one of said at least two locating bores when said cam mechanism is locked.

10. The pin pallet according to claim 8, said pin mechanism further including:

at least two dowel pins extending outwardly from said slide plate, and at least one locating bore positioned on said pin collar, wherein said one of said at least two dowel pins is inserted in said at least one locating bore when said cam mechanism is locked.

11. The pin pallet according to claim 8, wherein said curvilinear cam slot is provided with a cam notch, said cam notch interacting with said camming pin to abruptly move said handle collar relative to said at least one rail, and insert a dowel pin extending outwardly from said slide plate into a locating bore positioned on said pin collar when said cam mechanism is being locked, and withdraw said dowel pin from said locating bore when said cam mechanism is being unlocked.

12. The pin pallet according to claim 11, wherein a rib extends along the surface of said slide plate to maintain alignment of said pin mechanism with respect to said at least one rail and parallel rails are positioned along the top and bottom edges of said locking plate to reduce friction when said pin mechanism slides along said slot.

13. The pin pallet according to claim 12, further comprising:

a plurality of leg members extending downwardly from said frame for nesting said frame within an adjacent frame.

14. The pin pallet according to claim 13, further comprising:

a stop assembly slidably received in said slot to allow repeatable repositioning of said pin mechanism anywhere in said slot.

15. A pin pallet for holding metal stampings during transfer comprising:

a frame;

at least one rail secured to said frame, said at least one rail having a slot;

a pin mechanism slidably received in said slot including a locking plate received within the interior of said at least one rail, a slide plate positioned on the exterior of said at least one rail, and adapted to slide within said slot, said locking plate and said side plate having apertures therethrough, a mounting stub extending through said apertures and coupled to said locking plate, a pin collar provided at one end of said pallet pin, said pin collar having a pin collar bore adapted to receive said mounting stub, a handle assembly including a handle and a handle collar having a handle collar bore adapted to receive said mounting stub, a spring carried by said mounting stub, and interposed between said pin collar and said slide plate, and a cam mechanism incorporating said mounting stub and said handle assembly, said cam mechanism having a camming pin secured to said mounting stub, and a curvilinear cam slot disposed on said handle collar, wherein said camming pin and said curvilinear cam slot interact when said handle assembly is actuated to selectively lock and unlock said cam mechanism.

16. A pin pallet according to claim 15, wherein said pallet pin is selectively secured in a first position and a second position and said pin mechanism is clamped to said at least one rail when said cam mechanism is locked, and wherein said pallet pin is rotatable about said mounting stub and is moveable along the entire length of said slot when said cam mechanism is unlocked.

* * * * *